US005517773A

United States Patent [19]

Forrest et al.

[11] Patent Number: 5,517,773

[45] Date of Patent: May 21, 1996

[54] VARIABLE LENGTH SNOWSHOE

[75] Inventors: Bill Forrest, Denver; Patrick Smith, Golden, both of Colo.

[73] Assignee: Mountain Safety Research, Seattle, Wash.

[21] Appl. No.: 194,983

[22] Filed: Feb. 10, 1994

Related U.S. Application Data

[63] Continuation-in-part of Ser. No. 141,853, Oct. 22, 1993, Pat. No. 5,469,643.

[51] Int. Cl.[6] ..... A43B 5/04

[52] U.S. Cl. ..... 36/123; 36/122

[58] Field of Search ..... 36/122, 123, 124, 36/125, 116

[56] References Cited

U.S. PATENT DOCUMENTS

| | | | |
|---|---|---|---|
| 405,516 | 6/1889 | Watson . | |
| 1,004,900 | 10/1911 | Pease . | |
| 3,299,541 | 1/1967 | Snyder | 36/4.5 |
| 3,600,829 | 8/1971 | LaViolette | 36/4.5 |
| 3,638,333 | 2/1972 | Sprandel | 36/4.5 |
| 3,673,713 | 7/1972 | Fedewitz | 36/2.5 |
| 3,755,927 | 9/1973 | Dearborn | 36/2.5 |
| 3,760,513 | 9/1973 | Corneliusen | 36/124 |
| 3,861,698 | 1/1975 | Greig | 36/122 |
| 4,004,355 | 1/1977 | Koblick | 36/122 |
| 4,045,889 | 9/1977 | Woolworth | 36/122 |
| 4,271,609 | 6/1981 | Merrifield | 36/125 |
| 4,348,823 | 9/1982 | Knapp et al. | 36/123 |
| 4,351,121 | 9/1982 | Wallace | 36/125 |
| 5,014,450 | 5/1991 | McGrath | 36/124 |
| 5,251,388 | 10/1993 | Pozzobon et al. | 36/50.5 |
| 5,253,437 | 10/1993 | Klebahn et al. | 36/125 |
| 5,309,652 | 5/1994 | Campbell | 36/122 |

*Primary Examiner*—Thomas P. Hilliard
*Attorney, Agent, or Firm*—Sheridan Ross & McIntosh

[57] ABSTRACT

A variable length snowshoe (200) is provided to accommodate changing snow conditions or snowshoeing applications. The snowshoe (200) includes a flotation plate (202) and at least one detachable tail extender (204). The snowshoe (200) also includes detachable brakes (216) and toothed traction bars (212) to provide improved traction on ice and enhanced forward, rearward and side slipping protection. A de-icing crampon (214) and gripping tabs (210) which facilitate binding strap manipulation are also disclosed.

14 Claims, 11 Drawing Sheets

VARIABLE LENGTH SNOWSHOE

RELATED INFORMATION

This application is a continuation-in-part of U.S. patent application Ser. No. 08/141,853 filed on Oct. 22, 1993, now U.S. Pat. No. 5,469,643.

FIELD OF THE INVENTION

The present invention relates generally to snowshoeing and, in particular, to a novel snowshoe which provides adjustable flotation characteristics, improved side, forward and reverse slip protection, forward tracking guidance and overall stability and lightweight material options.

BACKGROUND OF THE INVENTION

According to some historians, the first snowshoes were developed about 6,000 years ago in Central Asia. Snowshoes have been used in North America for many centuries, first by native American peoples and later by trappers, explorers and other European settlers. Traditionally, snowshoes were formed from light oval or teardrop shaped wooden frames strung with thongs made from animal hide. The resulting snowshoe could then be strapped to a person's foot, i.e., directly or via footgear, so as to enable the person to walk in soft snow without sinking too deeply.

Today, snowshoes are most commonly used for recreation and by mountaineers to facilitate winter access to remote backcountry locations. Although the materials and production techniques have changed, modern snowshoes have much in common with traditional snowshoes developed over the centuries. FIG. 1 illustrates some features of one type of snowshoe 1 in common use today. The general shape of the snowshoe 1 is defined by a tubular perimeter structure 2 which is ordinarily formed from aluminum. The requisite flotation surface area is typically provided by webbing or a platform 3, formed from animal hide or synthetic materials, which is connected to the tubular perimeter structure 2 via sturdy lacing 4 or rivets. The snowshoe 1 is attached to the wearer's foot via footgear 5 using a toestrap 6, and an additional heel strap 7 is usually provided. Often, a hinged metal device or so-called crampon 8 which extends through an opening 9 in platform 3 is provided to improve forward traction on hills or ice.

Despite the long evolution of the snowshoe art, current snowshoes are subject to certain limitations. For example, when the snowshoer traverses a steep hill, current snowshoes are highly susceptible to side slippage. Similarly, current snowshoes can slip forwardly or rearwardly when a hill is addressed directly, particularly in icy conditions. In addition to being a source of annoyance, such slipping can be a matter of grave safety concern for the backcountry mountaineer. Conventional snowshoes do not always provide adequate protection against forward, rearward and side slippage.

Another limitation of current snowshoes is that the snowshoes have invariable flotation characteristics relating to the size of the snowshoe. However, the desired flotation characteristics of a snowshoe vary from user-to-user, from application-to-application, and depending on snow conditions or other factors. For example, a larger snowshoe is normally better for a heavier snowshoer, when carrying a heavy pack or when snowshoeing in deep and soft snow. Smaller snowshoes are typically preferred for running or racing (as is becoming increasingly popular). Many avid snowshoeing enthusiasts therefore have more than one pair of snowshoes.

This is not a completely satisfactory situation for a number of reasons. First, the expense of acquiring more than one pair of snowshoes is prohibitive for many. In addition, the snowshoer cannot always accurately predict what conditions may be encountered during an outing. Snow conditions can change rapidly, particularly in back-country mountaineering expeditions involving large altitude changes. Moreover, for outings lasting several days, conditions may change due to storms, wind, temperature changes and other weather phenomena. Furthermore, as can be readily appreciated, it is not always convenient to store and carry more than one pair of snowshoes.

Current snowshoes as described above are also subject to a certain instability relating to snow compaction. In particular, as the snowshoer places weight on the snowshoe, the platform tends to flex to a concave shape. As a result, snow may be forced towards the snowshoe perimeter rather than providing stable support under the snowshoer's foot.

Additionally, current snowshoes tend to create resistance to the shuffling movement entailed in forward snowshoeing. In this regard, the tubular perimeter and angled orientation of common snowshoe perimeter structures result in snow plowing when the snowshoe is shuffled in a forward direction. Moreover, current snowshoes generally do not facilitate forward tracking, i.e., even on flat ground, current snowshoes can easily drift transversely to the desired direction of travel during shuffling.

The snowshoe binding has also presented persistent challenges for snowshoe designers as many desired binding qualities seemingly demand incompatible design features. For example, the binding must be able to securely accommodate a variety of footgear sizes and styles in order to be suitable for general use. However, in order to facilitate proper snowshoeing motion and reduce strain on the snowshoer, the binding must provide excellent lateral foot stability, limit vertical movement of the snowshoer's footgear, and limit forward or rearward slipping of the footgear as may occur in hilly terrain. In addition, it is highly desirable to provide a binding which can be quickly and easily attached and detached even though the snowshoer's finger dexterity may be limited due to coldness or handgear.

Accordingly, there is a need for an improved snowshoe which addresses the limitations and challenges facing snowshoe designers.

SUMMARY OF THE INVENTION

The snowshoe of the present invention is designed to provide variable flotation characteristics, improved protection against slipping, improved forward tracking guidance and overall stability and reduced weight. In addition, the present invention includes a binding which is easy to construct and use, yet is capable of securely and stably engaging a variety of footgear and footgear sizes.

According to one aspect of the present invention, a snowshoe includes a flotation plate, a pair of side bars projecting downwardly from the flotation plate's lower snow contact surface and at least one rib formed in the flotation plate. The flotation plate is preferably formed from a lightweight and rigid or semi-rigid material such as thermal formed plastic. The side bars, which can be formed as an integral portion of the flotation plate or formed as separate pieces for attachment to the flotation plate, are laterally spaced for stability. The snowshoe preferably includes at least one rib defining an indentation in the bottom surface of the flotation plate and extending longitudinally from a trailing end of the flotation plate past the rear end of the side bars. Preferably, the snowshoe includes two such ribs, one adjacent to each of the side bars. In this manner, the torsional rigidity of the snowshoe is enhanced, particularly at the location of the rear and forward ends of the side bars. This allows for use of a thinner and lighter flotation plate than would otherwise be possible. Ribs may also be provided at the front end of the snowshoe extending past the front ends of the side bars. In one embodiment, the flotation plate has an opening through which a crampon and a forward portion of the snowshoer's foot can project, and the side bars are positioned adjacent the side edges of the opening. The side bars extend substantially linearly along the length of the flotation plate and preferably have narrow bottom and frontal profiles. In addition, the side bars have a length which is at least about equal to the length of the snowshoer's foot. The side bars can also include a lower edge having indentations, e.g., teeth, for improved traction. The side bar indentations are preferably formed with rounded upper extremities for improved fracture resistance.

The side bars provide a number of advantages relative to conventional snowshoes. First, the side bars penetrate into the snow during use and thereby afford positive protection against sideslipping. The side bars therefore provide for greater safety when traversing steep terrain. The side bars also impart improved torsional rigidity to the flotation plate so that the material requirements of the flotation plate can be reduced and a lighter weight snowshoe can be achieved. Moreover, the crampon can be connected to the side bars thereby shortening the crampon connection and reducing strain on the connection assembly. The side bars also penetrate the snow during shuffling movement substantially without plowing and contribute to forward tracking guidance. By providing a toothed lower edge on the side bars, improved traction and protection against forward or rearward slipping can also be imparted.

According to another aspect of the invention, a snowshoe with variable flotation characteristics is provided. The snowshoe comprises a flotation plate and at least one extension member which is detachably coupled to the flotation plate for selectively increasing the snow contact surface area of the snowshoe. Preferably, more than one extension member is provided to allow for a variety of snow contact surface areas. In one embodiment, the extension members comprise tail extenders which can be attached to a rearward portion of the flotation plate to increase the length of the snowshoe. An alignment mechanism can be provided to assist in attachment of the extension members and to insure stable alignment of the extension members during use. For example, the alignment members may comprise a mating coupling between the flotation plate and the extension members. Preferably, alignment is accomplished by providing mating longitudinal ribs in the flotation plate and extension members. Although a particular embodiment of the variable length snowshoe is described below, it will be appreciated that the variable length concept is applicable to various types of snowshoes.

According to a still further aspect of the present invention, the snowshoe is provided with brakes to resist undesired forward or rearward sliding. The snowshoe comprises a flotation plate, first and second longitudinal side bars, and a braking mechanism disposed adjacent to at least one of the side bars and angled relative to the side bar. The braking mechanism preferably comprises first and second brake members extending downwardly from the flotation plate. Each of the brake members is positioned adjacent one of the side bars and angled relative to that side bar. For example, the first and second brake members may be configured in a generally "v" shaped configuration with a small space provided between the two brake members. Preferably the "v" shaped configuration is oriented such that the widened end of the configuration is closest to the rear of the snowshoe. In this manner the braking mechanism provides a braking force to resist both forward and rearward sliding. Specifically, when the snowshoe slides forwardly, a braking force is exerted due to constricted snow flow between the brake members and the side bars. When the snowshoe slides rearwardly, a braking force is exerted due to constricted snow flow between the two brake members. Preferably, the brake mechanism is detachably coupled to the flotation plate so that the brake mechanism can be removed when speed is desired, e.g., racing.

According to a still further aspect of the present invention, a snowshoe with a de-icing crampon is provided. The snowshoe comprises a flotation plate and a de-icing crampon pivotally connected to the flotation plate. The crampon includes a substantially rigid platform having an aperture and a flexible covering disposed on the platform so as to cover the aperture. Preferably the aperture has a transverse width of at least about two inches and a longitudinal length of at least about one inch. More preferably, the aperture has a transverse width of at least about three inches and a longitudinal length of about two inches. In this manner, the flexible covering flexes into and out of the aperture during use such that ice build up is hindered.

According to yet another aspect of the present invention, a device for facilitating manipulation of a hand operated adjustment mechanism, such as a buckle, zipper or the like, is provided. For example, the device can be used in connection with a strap buckle on a snowshoe binding to facilitate adjustment of the binding when the user's fingers are cold, the user is wearing mittens, or finger dexterity is otherwise impaired. The device comprises a unitary tab member formed from flexible material. The tab member includes a first widened portion, a second widened portion, and a narrowed portion disposed between the first and second widened portions. The first widened portion has an opening and a first tapered end for threadably engaging an aperture of the hand operated adjustment mechanism. The second widened portion has a second tapered end for threadably engaging the opening of the first widened portion. The tab member can be attached to the hand operated adjustment mechanism by threading the first widened portion through the aperture of the hand operated adjustment mechanism, wrapping the tab member around a portion of the hand operated adjustment mechanism, and inserting the second widened portion through the opening of the first widened portion until the narrowed portion is received within the opening. The narrowed portion thus serves to secure the tab member in place. During use, the outwardly extending second widened portion provides a relatively large tab to assist in manipulating the hand operated adjustment mechanism. The second widened portion may be provided with an opening to further assist in gripping thereof. In addition, each of the first and second widened portions can be provided with a tongue to assist in threading.

DETAILED DESCRIPTION

Figure 1:
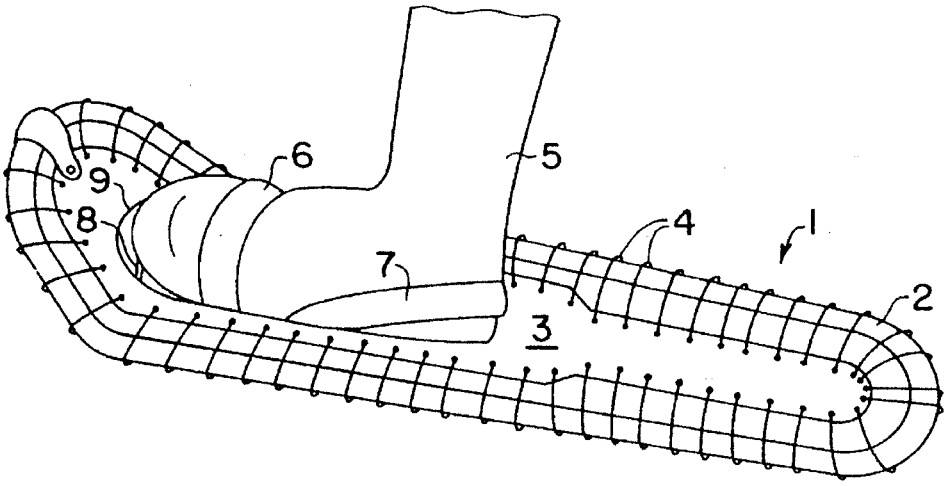
FIG. 1 PRIOR ART
FIG. 1, as described in the Background of the Invention, illustrates some features of one type of prior art snowshoe.
Figure 2:
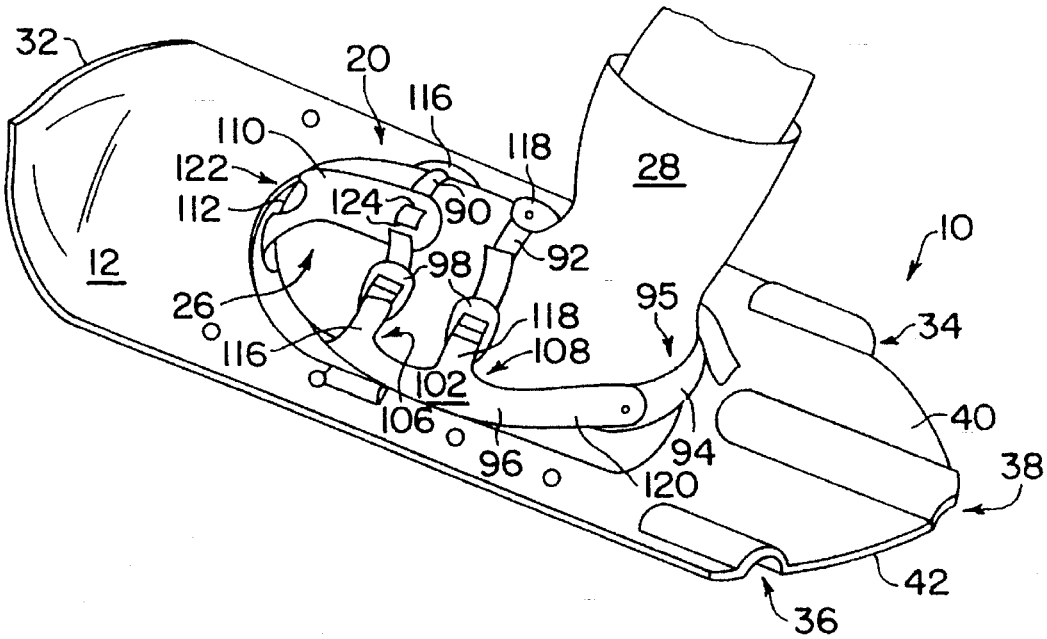
FIG. 2 is a perspective view of a snowshoe constructed in accordance with the present invention.
Figure 3:
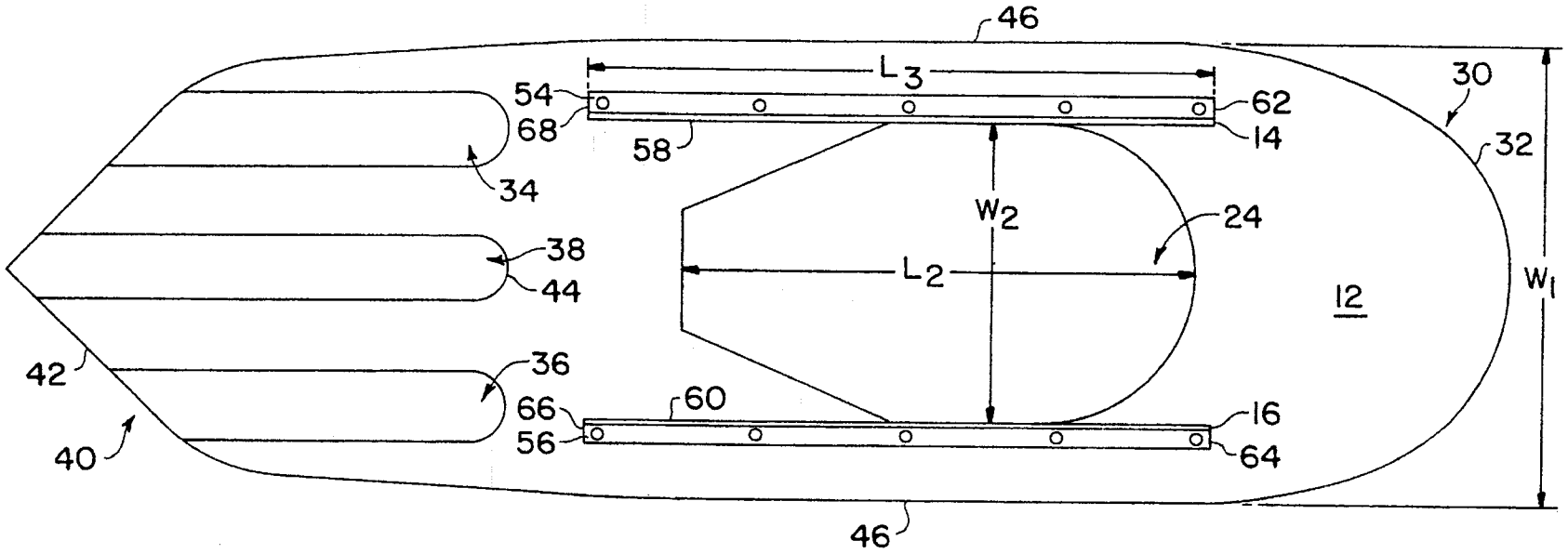
FIG. 3 is a bottom view showing the flotation plate and side bars of the snowshoe of FIG. 2.
Figure 4:
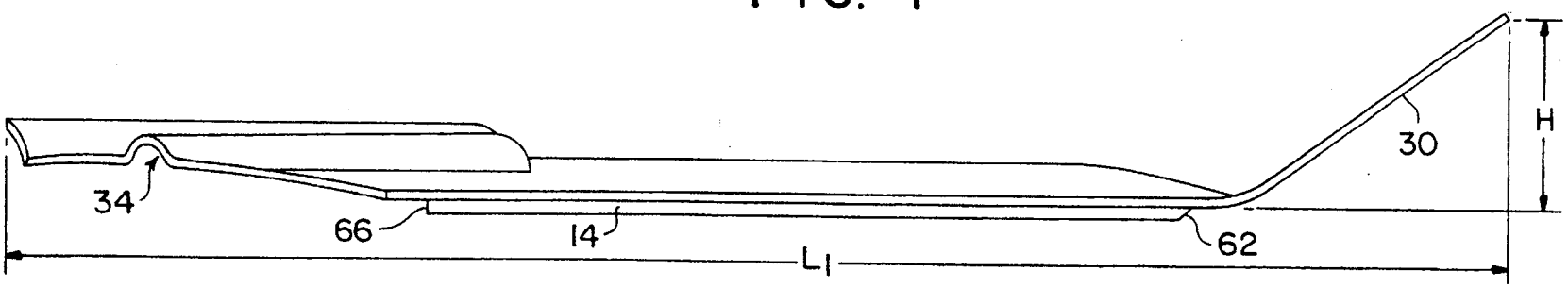
FIG. 4 is a side view of the flotation plate and side bars of the snowshoe of FIG. 2.

Referring to FIGS. 2–8, a snowshoe constructed in accordance with the present invention is generally identified by the reference numeral 10. Generally, the snowshoe 10 comprises a flotation plate 12, side bars 14 and 16, a crampon 18 and a binding 20. In the illustrated embodiment, the binding is designed for attachment to a snowshoer's footgear 28.

The flotation plate 12 can be formed from any of various lightweight semi-rigid materials such as various plastics. The illustrated flotation plate 12 is formed from 3/16 or 1/8 inch thick thermal formed, high density polyethylene which provides adequate strength and rigidity and allows for simple and inexpensive construction. The overall dimensions of the flotation plate 12 can be varied depending on the weight or skill of the snowshoer, the size of the snowshoer's footgear 28, local snow conditions, the load being carried or other factors. In this regard, the snowshoe 10 can be provided, for example, in various lengths (e.g., 22 inches, 26 inches or 30 inches) and widths (e.g., 8 inches or 9 inches) to accommodate a range of conditions. The illustrated flotation plate 12 has a length $L_1$ of about 26 inches and a width $W_1$ of about 8 inches.

The shape of the flotation plate 12 is further defined by a number of molded curves and channels and a central cut-out 24. The cut-out 24 is provided to allow the crampon 18 and a toe section 26 of the snowshoer's footgear 28 to extend through the flotation plate 12 for improved traction. The illustrated cut-out 24 has a length $L_2$ of about 8.75 inches and a width $W_2$ of about 5.25 inches. The flotation plate 12 can also be provided with perforations (not shown) to minimize snowshoe weight.

In order to facilitate forward shuffling of the snowshoe 10 through snow, the tip portion 30 of the flotation plate 12 adjacent leading edge 32 is curved upwardly. The upward curve begins just forward of the cut-out 24, about 5 inches from leading edge 32. The curve defines an approximately 36° angle relative to horizontal such that the forwardmost point of leading edge 32 is elevated to a height H of about 3.75 inches relative to the base of flotation plate 12. As will be better understood upon consideration of the description below, the upward curve is actually a compound curve resulting from the blending of the upward tip projection and the overall convex frontal profile of the flotation plate 12 as can be see in FIG. 5.

In the illustrated embodiment, the flotation plate 12 further includes a pair of side channels 34 and 36 and a central channel 38, each of which extends along a rear portion 40 of the flotation plate 12 to rear edge 42. The channels are formed as recesses into the underside of flotation plate 12. The illustrated central channel is about ½–¾ inch wide, ½–¾ inch deep and its front edge 44 is located rearwardly from cut-out 24. The side channels 34 and 36 are slightly smaller than the central channel 38, e.g., about ⅜–½ inch wide and ⅜–½ inch deep. During forward travel, snow passes through the channels 34, 36 and 38 and exits at the rear edge 42 of the snowshoe 10 such that the channels 34, 36 and 38 enhance forward tracking guidance. These channels 34, 36 and 38 also add rigidity to the rear portion 40 of the flotation plate 12.

In an alternative embodiment (not shown), the side channels are eliminated, the side bars extend further towards the rear edge of the flotation plate and the central channel is enlarged. In addition, the central channel has a tapered profile which extends upwardly relative to the flotation plate such that the snowshoer's footgear is urged forwardly due to the taper inclination.

Figure 5:
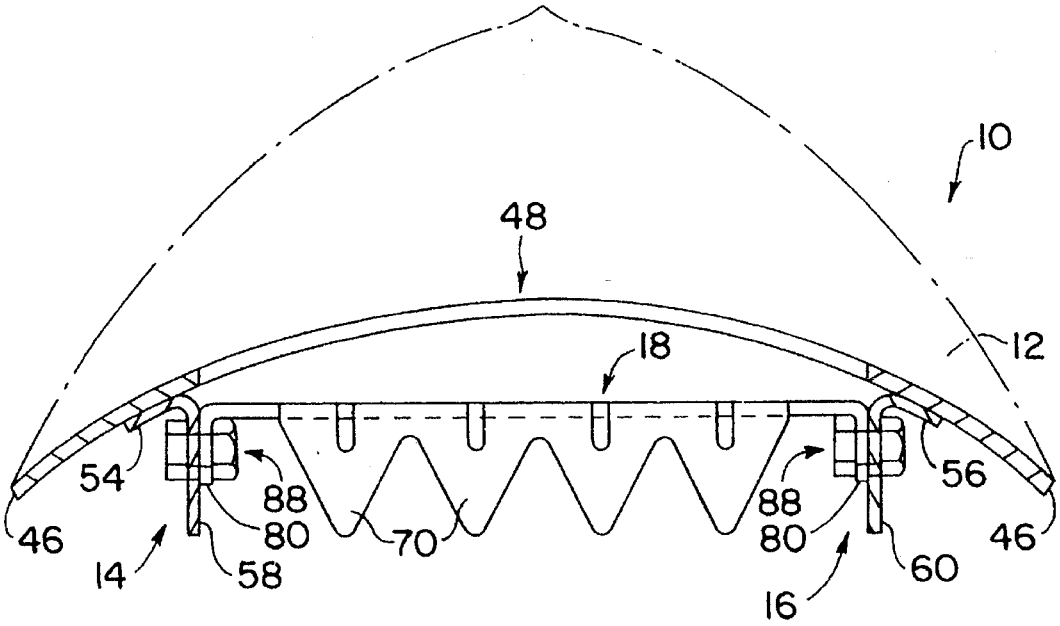
FIG. 5 is a cut-away front view of the flotation plate, side bars and crampon of the snowshoe of FIG. 2.
Figure 7:
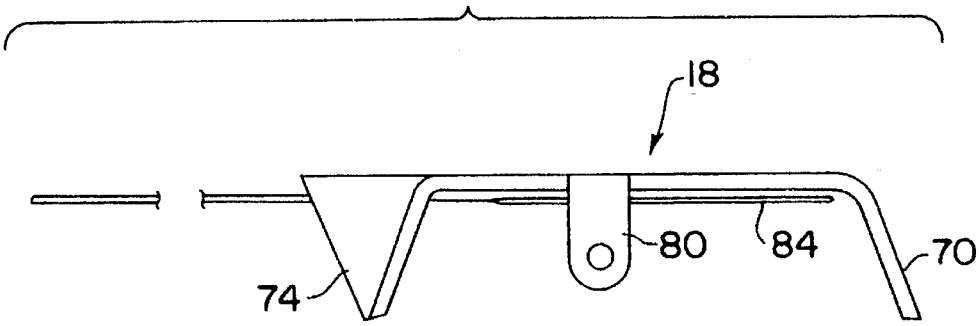
FIG. 7 is a side view of the crampon of the snowshoe of FIG. 2.

As can be most clearly seen in FIG. 5, the flotation plate 12 has a convex frontal profile such that the side edges 46 are positioned lower than a central portion 48 of the flotation plate 12. In the illustrated embodiment, this profile is defined by a radius of curvature of about 12 inches. When the snowshoer places weight on the snowshoe 10 thereby forcing the flotation plate 12 downwardly into the snow, the convex frontal profile causes snow to gather or move towards the center of the flotation plate 12 so that a stable snow platform is provided beneath the snowshoer's foot. In addition, as the snowshoer shuffles forwardly, the convex flotation plate 12 forms a snow ridge which further assists in forward tracking guidance.

The snowshoe 10 further includes a pair of side bars 14 and 16 which project downwardly from flotation plate 12. The side bars 14 and 16 can be molded into flotation plate 12 or formed separately for attachment to flotation plate 12. The illustrated side bars 14 and 16 are formed from 3/32 inch thick aluminum and are attached to flotation plate 12 via rivets, screws or other fasteners extending through side bar flanges 54 and 56 into flotation plate 12. The side bars 14 and 16 thereby have narrow frontal and bottom profiles which facilitate snow penetration. The angle between each of the flanges 54 and 56 and the corresponding downward projections 58 and 60 of side bars 14 and 16 is formed such that the projections 58 and 60 extend substantially vertically downward when the flanges 54 and 56 are attached to the convex lower surface of flotation plate 12.

The side bars 14 and 16 preferably have a length $L_3$ which is at least about as great as the length of the snowshoer's footgear 28. In this regard, the illustrated side bars 14 and 16 are about 12 inches long and are positioned such that the front edges 62 and 64 thereof are about ½ inch forward from cut-out 24. The side bars extend substantially linearly from the front edges 62 and 64 to the rear edges 66 and 68 thereof and are oriented parallel to the direction of forward travel so that substantially no snow plowing occurs during shuffling. In addition, the front edges 62 and 64 in the illustrated embodiment are beveled to further facilitate snow penetration and to allow the side bars 14 and 16 to smoothly ride up over obstructions.

The depth of the downward projections 58 and 60 is selected such that the side bars 14 and 16 provide protection against side slipping of the snowshoe 10 and also allow for extension of the crampon 18 below the side bars 14 and 16 for improved forward traction on hills or ice or braking when descending same. Furthermore, the depth of the side bars 14 and 16 is preferably about equal to the depth of the crampon claws when the crampon 18 is in a level orientation. The illustrated side bars 14 and 16 extend downwardly about 9/10 inch from flotation plate 12. If desired, the side bars 14 and 16 can be serrated for additional traction. In addition to protecting against side slipping, it will be appreciated that the illustrated side bars 14 and 16 further enhance forward tracking guidance and impart longitudinal torsional rigidity to the snowshoe 10 and allow the use of somewhat flexible materials in the flotation plate 12.

Figure 6:
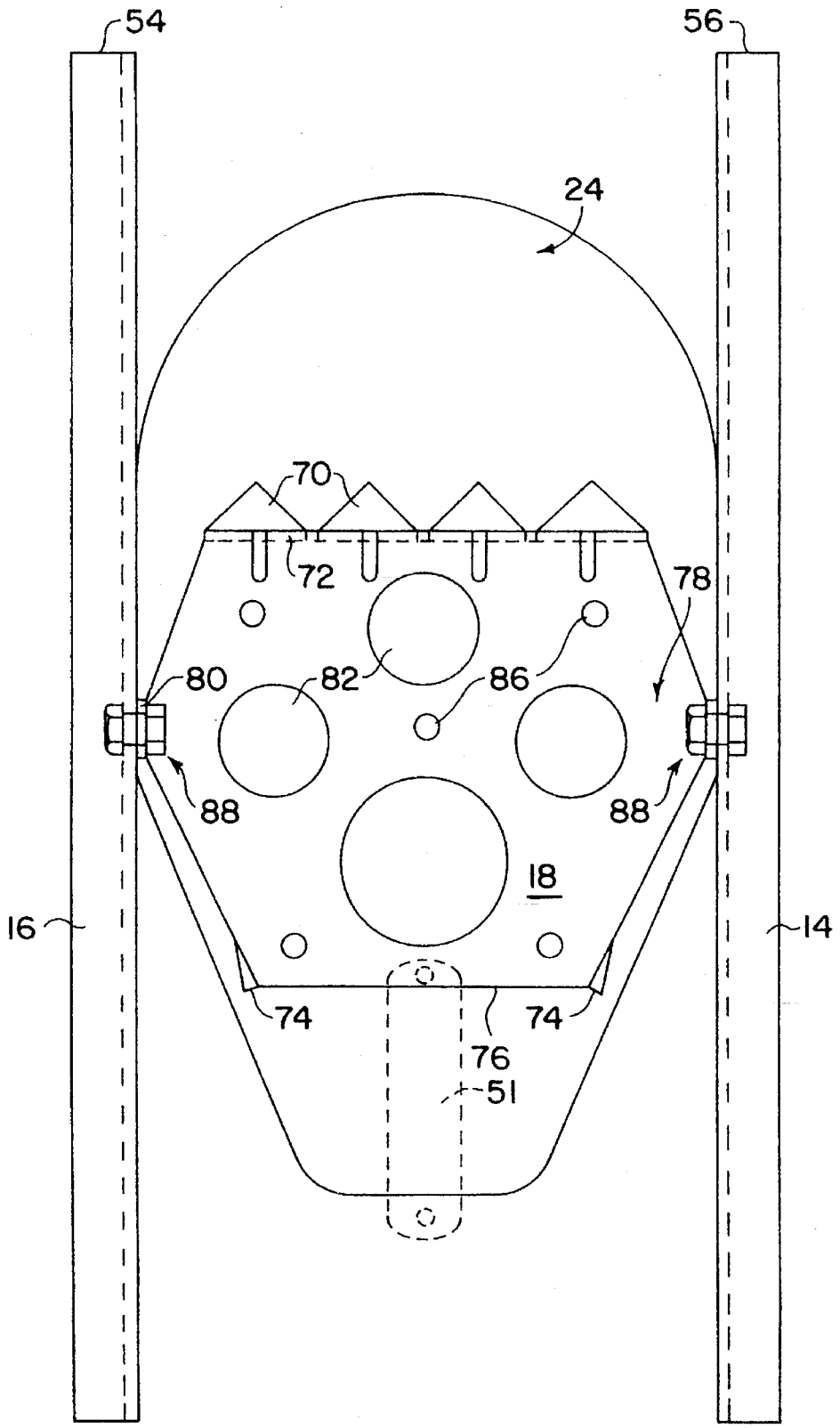
FIG. 6 is a bottom view showing the interconnection between the crampon and side bars of the snowshoe of FIG. 2.

As shown most clearly in FIGS. 5–6, the side bars 14 and 16 are spaced across the width of the snowshoe 10. Preferably, the side bars 14 and 16 are spaced by a distance at least about as great as the width of the snowshoer's footgear 28. In the illustrated embodiment, the side bars 14 and 16 are positioned adjacent the sides of cut-out 24 with the flanges 54 and 56 projecting outwardly. This positioning allows the crampon 18 to be attached to the side bars 14 and 16 such that the crampon connection is short and stress on the connection is minimal as it is substantially totally in shear. The illustrated crampon 18 is connected directly to the side bars 14 and 16 using pins 88 which allow for pivoting of the crampon 18 with the snowshoer's footgear 28.

The crampon 18, which can be formed from a number of materials, such as plate steel or aluminum, includes a number of front claws 70 at its front edge 72 and a number of rear claws 74 at its rear edge 76 for traction. The front claws 70 and rear claws 76 each define an obtuse angle, e.g., approximately 95°, relative to the crampon base for improved forward and rearward traction. In addition, the crampon includes a widened portion 78 provided with downwardly projecting wings 80 for attachment to the side bars 14 and 16. The attachment pins 88 are positioned on snowshoe 10 such that more of the snowshoe weight is located rearwardly of the pins 88 so that the snowshoe tip portions 30 naturally rotate upwardly. To reduce weight, perforations 82 can be formed in crampon 18. Furthermore, in order to minimize icing of the crampon 18, the crampon 18 can be covered with a plastic material 84. The laminate 84 can be attached to the crampon base, for example, via rivets inserted through holes 86. If desired, a flexible strap 51 (shown in phantom in FIG. 6) may be used to interconnect the crampon 18 to flotation plate 12 so as to limit the pivoting range of the crampon 18.

The snowshoer's footgear 28 is attached to the snowshoe 10 by binding 20. The illustrated binding 20 includes a toe strap 90 which extends over a toe section 26 of footgear 28, an instep strap 92 which extends over an instep section 108 of footgear 28, a heel strap 94 which extends around heel section 95 of footgear 28 and foot wrap 96 which wraps about portions of footgear 28. Each of the straps 90, 92 and 94 is provided with an adjustable glide buckle 98 formed from substantially rigid plastic to allow for convenient and quick tightening of the straps 90, 92 and 94 by simply pulling on the strap ends. The foot wrap 96, which is preferably formed from a strong, flexible water repellent material, is attached to the crampon 18 using fasteners such as rivets or stitching, which can be the same fasteners used to attach the material 84 to the crampon 18. In the illustrated embodiment, the foot wrap is formed from vinyl coated polyester to provide the desired strength, flexibility and waterproof properties and resistance to cold cracking.

Figure 8:
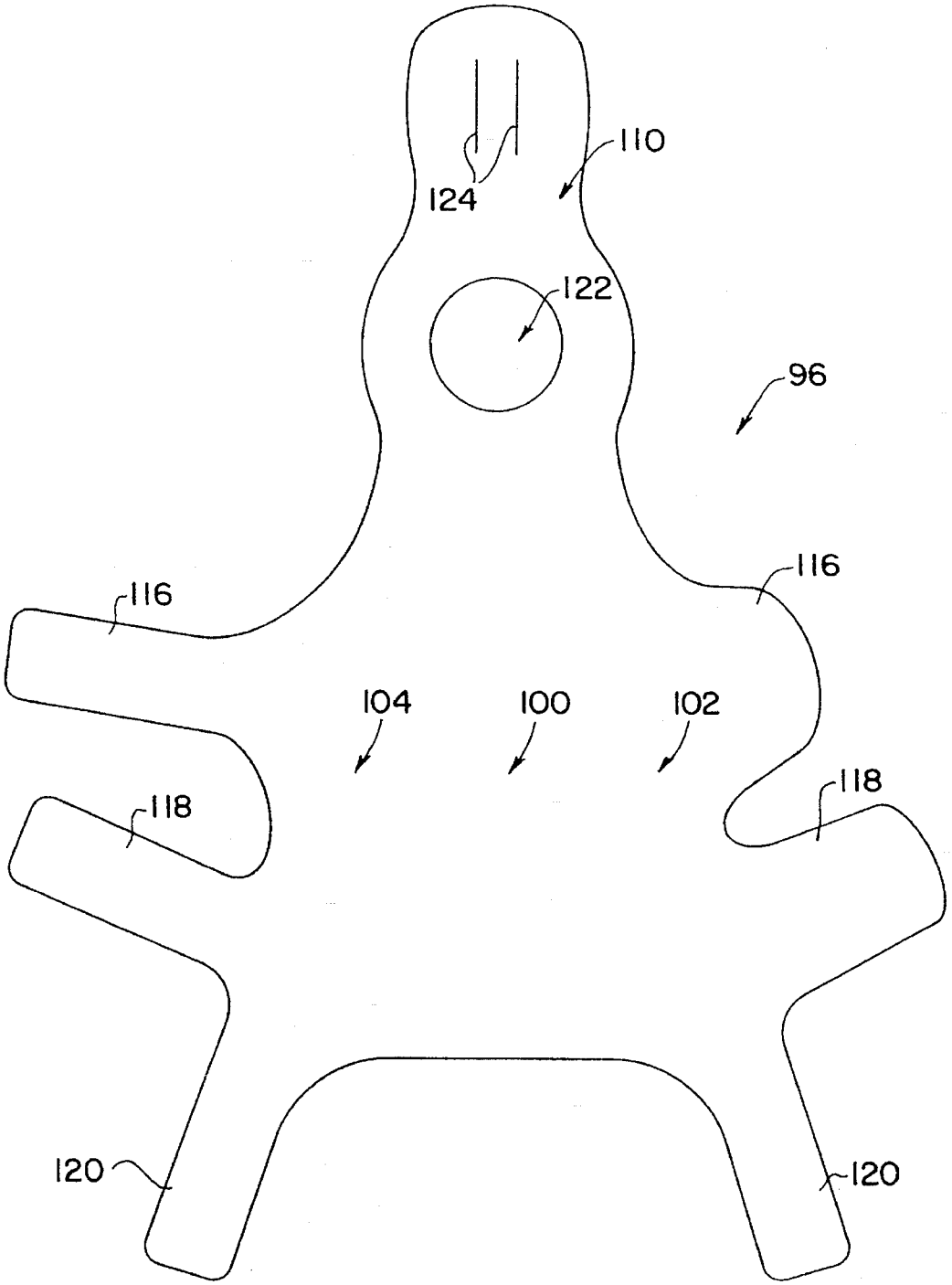
FIG. 8 is a top plan drawing showing the unfolded shape of the foot wrap of the snowshoe of FIG. 2.
Figure 9:
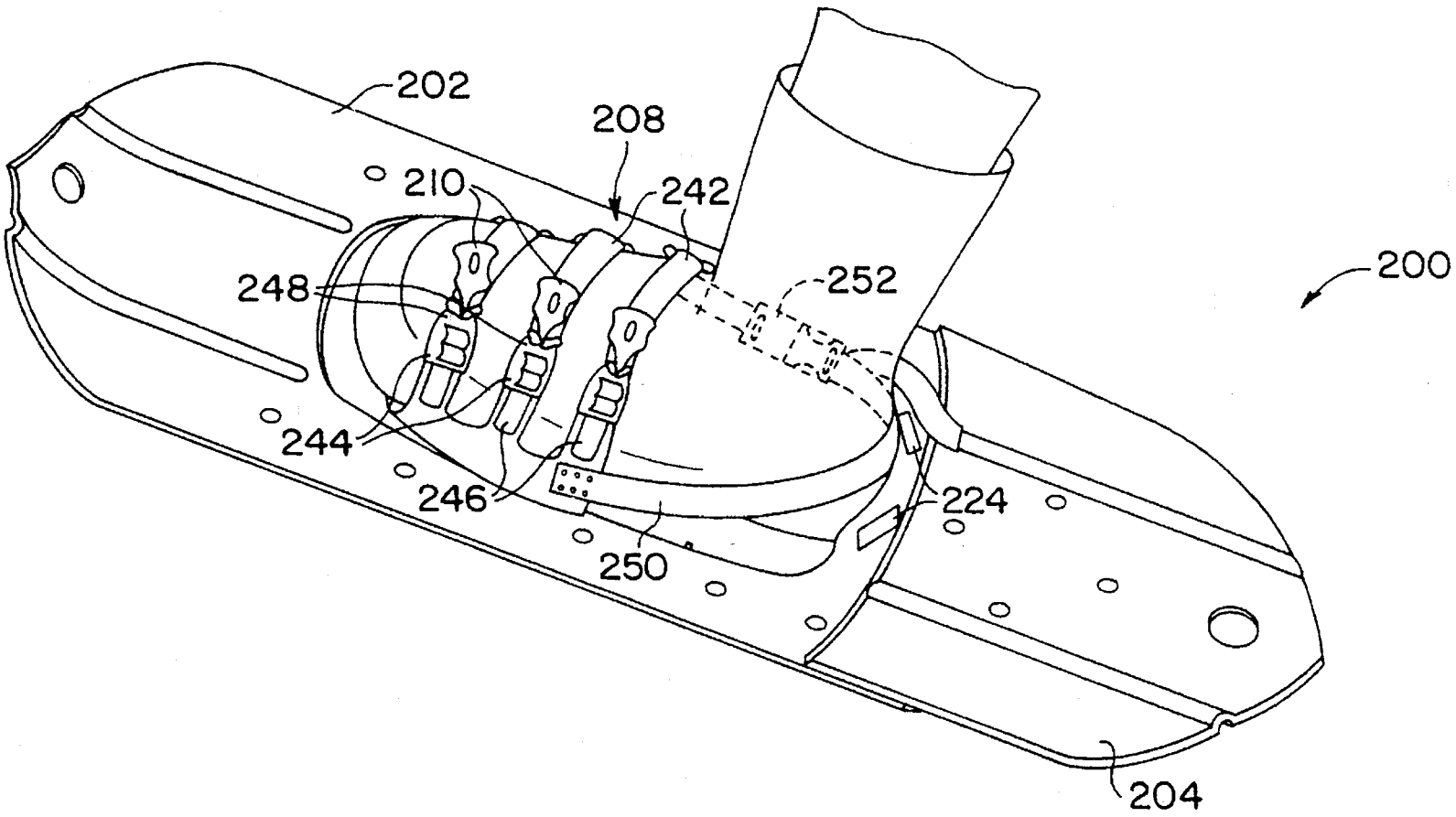
FIG. 9 is a perspective view of a snowshoe constructed in accordance with an alternative embodiment of the present invention showing attachment of a tail extender.
Figure 10:
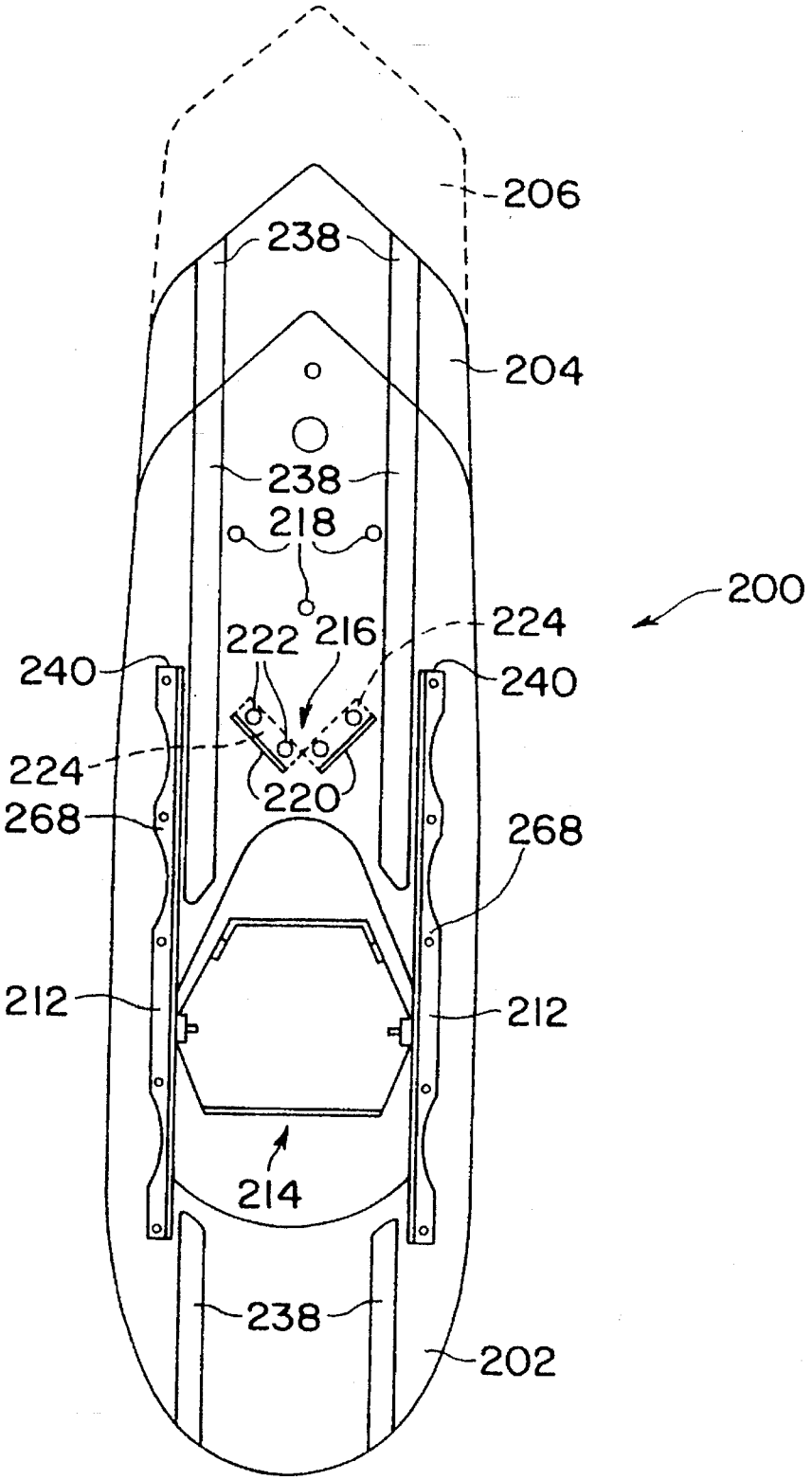
FIG. 10 is a bottom view of the snowshoe of FIG. 9 with an optional second tail extender shown in phantom.
Figure 11:
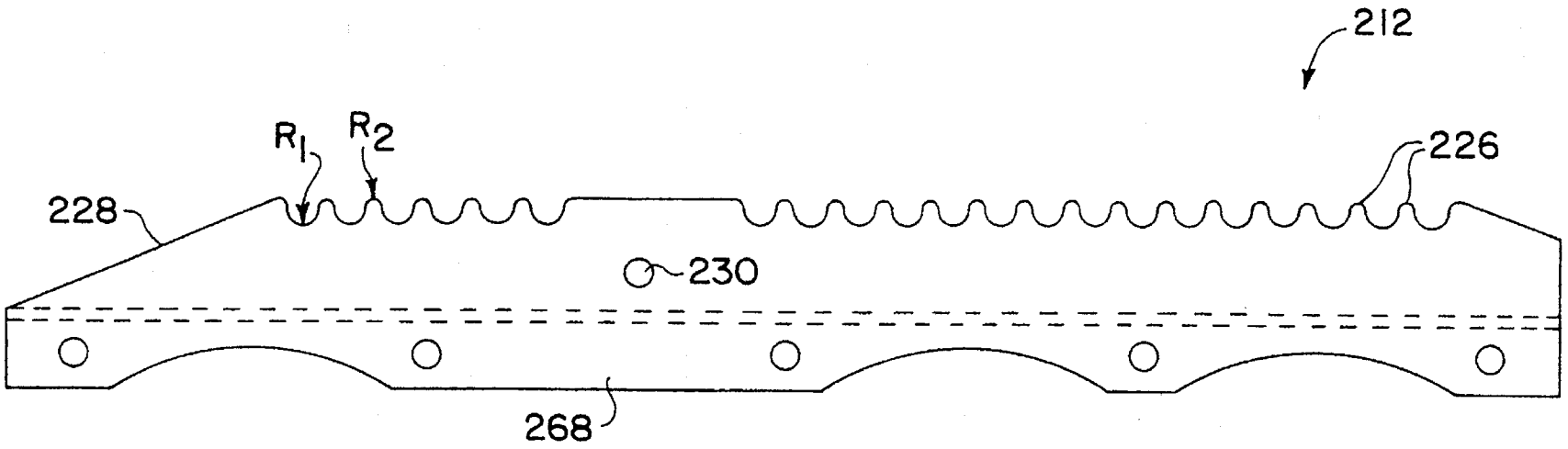
FIG. 11 is an elevational plan view of a side bar where the dashed lines indicate where the side bar will be bent to allow for attachment to the snowshoe flotation plate.

FIG. 8 shows a top plan view of the unfolded foot wrap 96. The foot wrap 96 includes a base portion 100 for attachment to the crampon 18, right 102 and left 104 side portions which wrap around the footgear 28 from the ball section 106 to the instep section 108 thereof, and a toe flap portion 110 which extends around the front edge 112 and over the toe section 26 of the footgear 28. In addition, the foot wrap 96 includes toe wings 116, instep wings 118 and heel wings 120 for attachment to the respective toe strap 90, instep strap 92 and heel strap 94. The wings 116, 118 and 120 on one side of foot wrap 96 are attached to the straps 90, 92 and 94 by threading the wings 116, 118 and 120 through one side of the buckles 98, doubling the wings 116, 118 and 120 over on themselves, and stitching or otherwise attaching the wings 116, 118 and 120 to themselves or adjacent portions of the foot wrap 96. The straps 90, 92, and 94 are then threaded through the other side of the buckles 98 to complete the attachment. On the opposite side of foot wrap 96, the wings 116, 118 and 120 can be connected directly to the straps 90, 92 and 94.

The toe flap portion 110 is widened and includes an opening 122 at the area corresponding to the front edge 112 of footgear 28. This allows the toe flap portion 110 to flare around the front edge 112 of footgear 28 so as to securely engage the same and enhance both lateral and longitudinal stability. The toe flap portion 110 is further secured by threading the toe strap 90 through slits 124 in toe flap portion 110.

The illustrated binding 20 thus provides excellent lateral foot stability and securely limits both longitudinal and vertical footgear movement. In addition, the binding 20 accommodates footgear 28 of various sizes and styles and is easily and quickly attached to or detached from footgear 28. The binding 20 is also suitable for use on either the left or the right foot, thereby allowing for interchangeability of the snowshoe 10.

Referring to FIGS. 9–15, an alternative embodiment of the snowshoe 200 of the present invention incorporating additional features is illustrated. Generally, the snowshoe 200 includes: a flotation plate 202 with detachable tail extenders 204 and 206; a binding 208 with novel gripping tabs 210; toothed traction side bars 212; a de-icing crampon 214; and detachable brakes 216.

The flotation plate 202 can be formed from a semi-rigid material, such as plastic, and is generally shaped as described above in connection with the embodiment of FIGS. 2–8. However, the flotation plate 202 includes extended ribs 238 on front and rear portions thereof (as well as across the entire length of the tail extenders 204 and 206) for enhanced torsional rigidity, thereby allowing for a thinner and lighter flotation plate 202 than would otherwise be possible. Particular benefits are achieved by extending each of the ribs 238 past the front 240 and rear 242 ends of the traction bars 212 where large torsional forces are exerted. The ribs 238 are preferably positioned adjacent to the traction bars 212.

The snowshoe 200 allows the snowshoer to vary the snowshoe flotation characteristics as may be desired. This can be accomplished by attaching extenders to vary the snowshoe length and, hence, the snow contact surface area. The illustrated snowshoe 200 is provided with two different lengths of tail extenders 204 and 206 which can be selectively attached to a rear portion of flotation plate 202. For example, the flotation plate can be about 22 inches long and the tail extenders 204 and 206 can provide for a total snowshoe length of 26 inches and 30 inches, respectively. These three lengths accommodate a great variety of conditions and applications.

Any suitable means may be utilized for attaching the tail extenders 204 and 206 to the flotation plate 202. However, it will be appreciated that the resulting connection must be strong enough to withstand the pressures exerted thereon in use and should allow for easy attachment and removal, preferably without the need to remove hand gear. As shown, the tail extenders 204 and 206 are removably attachable to the flotation plate 202 via a conventional nut and bolt 218 arrangement. The same fasteners which form the rearward-most connection between the traction bars 212 and the flotation plate 202 can be used to attach the tail extenders 204 and 206 for increased strength. To further facilitate attachment/detachment, a mechanism for assisting in alignment of the flotation plate 202 and tail extenders 204 and 206 can be provided. For example, appropriately positioned mating members, e.g., tongue and groove or abutting shoulders, can be formed on opposing surfaces of the flotation plate 202 and tail extenders 204 and 206 to ensure proper registration. In the illustrated embodiment, the mating ribs 238 of the flotation plate 202 and tail extenders 204 and 206, respectively, assist in such alignment and further serve to maintain alignment during use.

The snowshoe 200 also includes detachable brakes 216 which work in cooperation with traction bars 212 to provide improved traction and resistance to forward and rearward sliding. The brakes 216 are formed from two plates 220 extending downwardly from the flotation plate 202 adjacent to the traction bars 212. The plates 220, which may be formed from aluminum, steel or other substantially rigid material, extend from the flotation plate slightly less distance than the traction bars 212, about ⅜" and can be oriented at about a 45° angle relative to the traction bars 212. In the illustrated embodiment, a space of about ¾ inch is provided between the two plates 220 and between each of the plates 220 and the adjacent traction bar 212.

The resulting "v" configuration of the brakes 216 is preferably oriented such that the widened end of the "v" is closest to the rear of the snowshoe. In this manner, a braking force is exerted during forward sliding due to constricted snow flow between the plates 220 and side bars 216 and during rearward sliding due to constricted snow flow between the plates 220. The plates 220 are detachably connected to the flotation plate 202 via conventional nut and bolt 222 assemblies extending through flotation plate 202 and the flanges 224 of plates 220.

The construction of the traction bars 212 is generally similar to that of the side bars described above in connection with FIGS. 2–8. However, the illustrated traction bars 212 are further provided with teeth 226 formed on the lower edges 228 thereof. The teeth 226 provide enhanced traction on icy surfaces and further assist in preventing undesired forward or rearward slipping. The illustrated teeth 226 are formed with curved extremities for improved fracture resistance. In particular, the illustrated teeth are formed with a radius of curvature $R_1$ of about ⅛ inch defining the lower extremities and a radius of curvature, $R_2$ of about 1/16 inch defining the upper extremities. Although other curvatures may be used, the illustrated geometry has been found to provide a good combination of traction and fracture resistance. In addition, in the illustrated embodiment, the tooth pattern is interrupted at the point of attachment 230 of the crampon 214 to the traction bars 212, where fracturing stresses are greatest, to further guard against fracture. The attachment flanges 268 of the traction bars 212 can be scalloped to further reduce weight.

The crampon 214 alleviates ice build-up problems associated with certain known crampon devices. The crampon 214 includes a rigid substrate 232, which may be formed from steel or other suitably strong material, constructed generally as described above in connection with the embodiment of FIGS. 2–8, and a flexible diaphragm 234 attached to the substrate 232. The illustrated crampon has a number of forwardly angled claws 237 and rearwardly angled claws 239. Binding 208 is attached to the upper surface of substrate 232.

The substrate 232 includes a relatively large aperture 236. The aperture 236 reduces the total weight of the crampon 214 and also cooperates with the diaphragm 234 to pop-out any accumulated ice on the crampon 214 during use. Specifically, during use, the diaphragm 234 flexes into and out of the aperture 236 as a natural result of the snowshoer's striding motion thereby preventing ice build-up. The aperture's length, L, is preferably at least one inch and width, W, is preferably at least two inches. The dimensions of the illustrated aperture are at least about: L=2 inches; W=3 inches.

Figure 12:
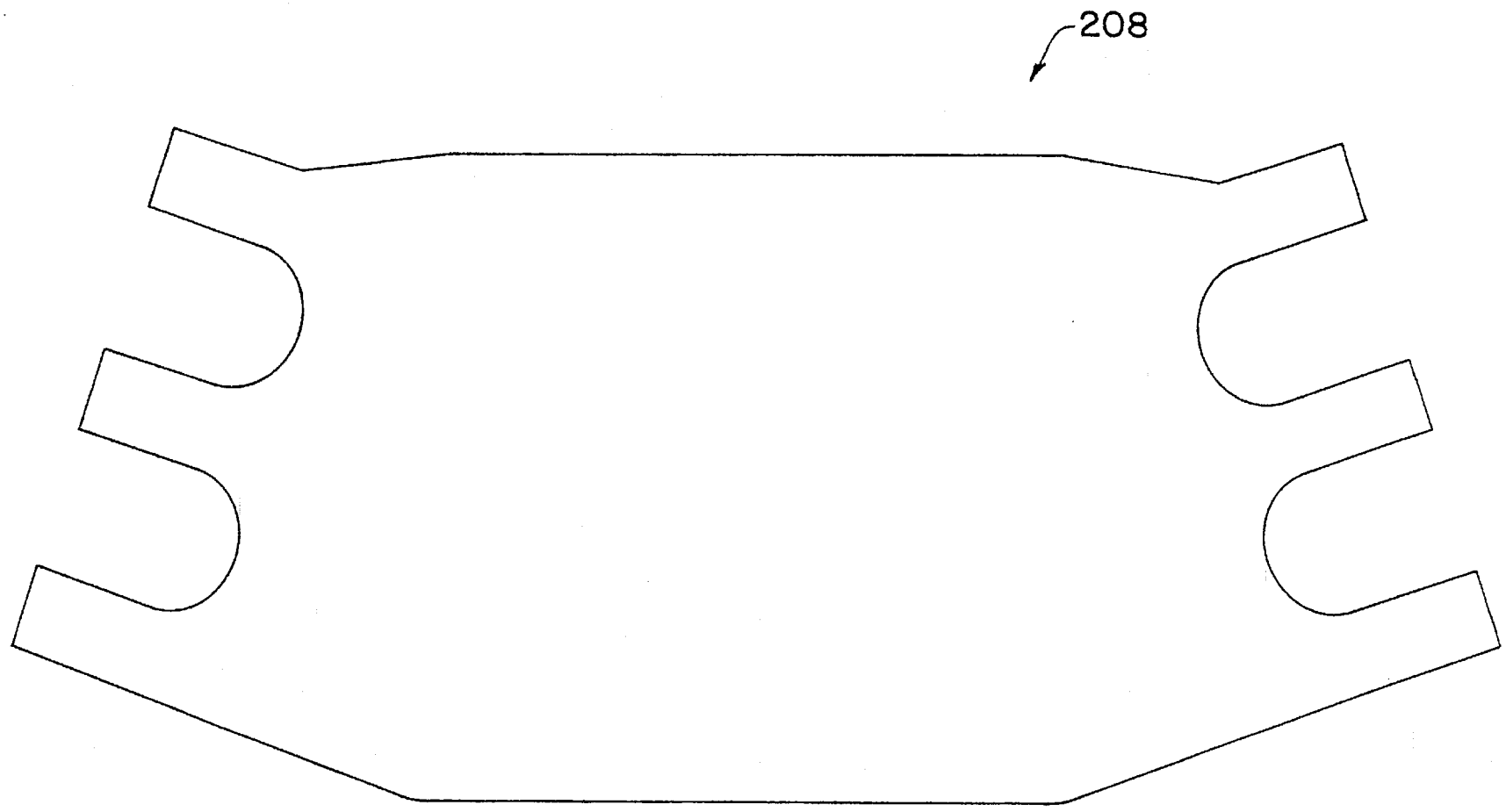
FIG. 12 shows the unfolded shape of the foot wrap of the snowshoe of FIG. 9.
Figure 13:
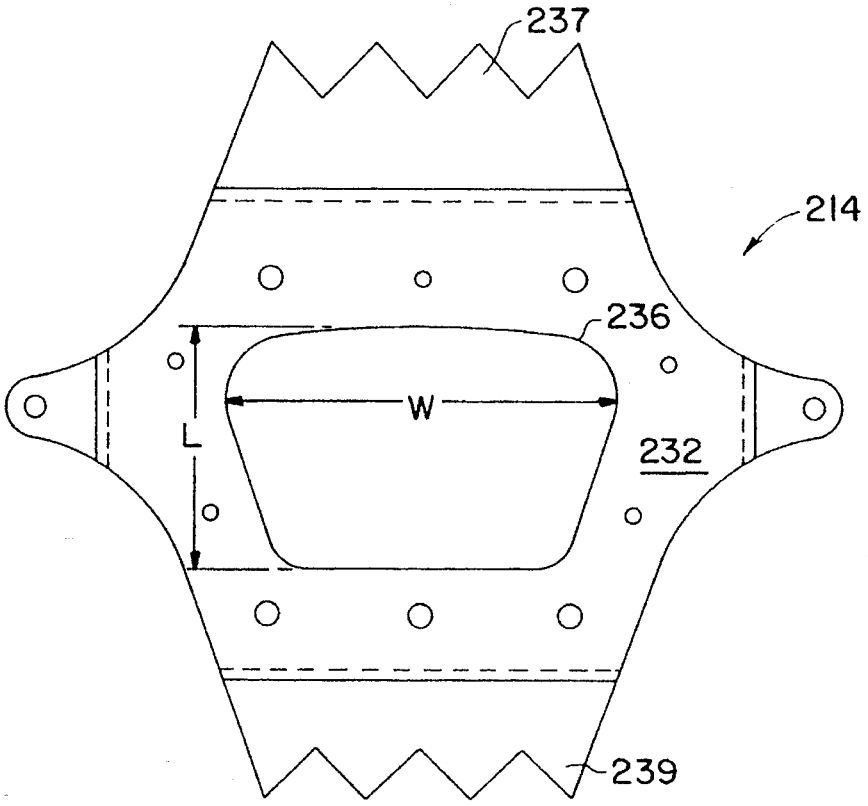
FIG. 13 shows the pre-formed shape of the crampon of the snowshoe of FIG. 9.

An alternative form of the binding 208 is also shown in connection with the embodiment of FIGS. 9–15 (shown in FIG. 12 without straps). The binding 208, like the binding described above in connection with the embodiment of FIGS. 2–8, can advantageously be formed in a unitary construction from a sheet of heavy weight vinyl coated nylon. However, the binding 208 is constructed in an open-toe style and includes three straps 242 distributed over the toe-to-ball regions of the snowshoer's foot. As discussed above, the straps 242 can be secured by conventional glide buckles 244 formed from substantially rigid plastic, wherein the straps are tightened by pulling on strap ends 246 and loosened by lifting buckle ends 248. The binding 208 further includes a heel strap 250 which is preferably secured by a conventional snap buckle 252 for convenient entry and exit.

Figure 14:
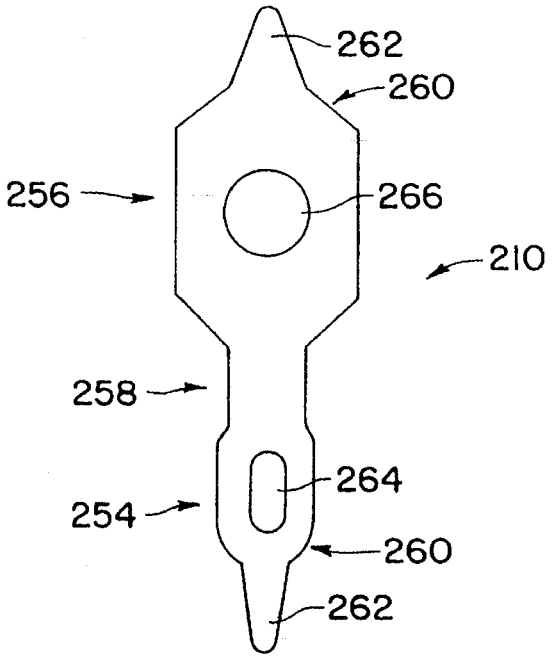
FIG. 14 shows the unfolded shape of the gripping tab of the snowshoe of FIG. 9.
Figure 15:
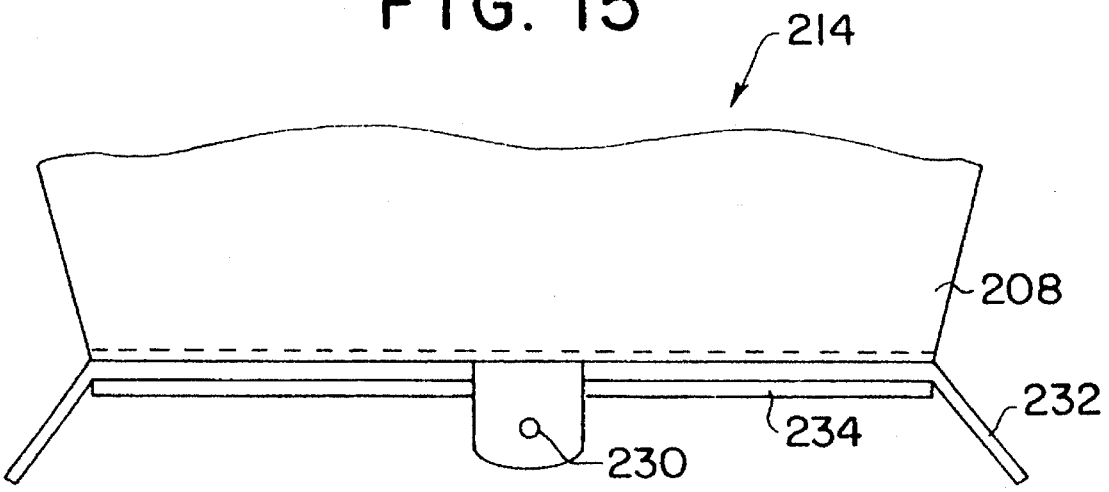
FIG. 15 is a side view of the crampon of the snowshoe of FIG. 9.

It has been found that it is sometimes difficult to manipulate the glide buckles 244, and particularly to lift buckle ends 248 to loosen the straps 242, when the snowshoer is wearing hand gear, the snowshoer's fingers are cold, or the snowshoer's finger dexterity is otherwise limited. This difficulty is alleviated in accordance with the present invention by providing gripping tabs 210 (FIGS. 9 and 14) attached to the buckle ends 248 via an aperture provided therein. The gripping tabs 210 can be formed in a unitary construction from a sheet of the same flexible, durable, tear resistant material used in constructing the binding 208 and crampon diaphragm 234. As shown in FIG. 14, gripping tab 210 includes a first widened portion 254, a second widened portion 256 and a narrowed portion 258 positioned therebetween. Each of the widened portions 254 and 256 is tapered towards an outer end 260 thereof and can further be provided with an outwardly extending tongue 262 to assist in threading as will be understood from the following description.

A gripping tab 210 is attached to a buckle 244 by threading the first widened portion 254 through the aperture in buckle end 248, wrapping the tab 210 about the buckle end 248 and pulling the second widened portion 256 through an opening 264 in the first widened portion 254 so that the narrowed portion 258 is seated in the opening 264. In this regard, the narrowed portion serves to lock the tab 210 in place. The opening 264 may be elongated as shown to facilitate threading of the second widened portion 256 therethrough. Additionally, a second opening 266 may be provided in the second widened portion 256 to facilitate gripping. It will be appreciated that the tab 210 is useful in a variety of hand operated adjustment mechanisms, such as zippers, other than the snowshoe strap buckle application shown.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A snowshoe, comprising:

a) flotation means for providing a snow contact surface area, said flotation means having a longitudinal length and a transverse width; and b) pivotable platform means for interfacing said flotation means and a wearer's foot, said platform means comprising a rigid platform having an aperture and a flexible covering disposed on said platform so as to cover said aperture.

2. The snowshoe of claim 1, wherein said aperture has a transverse width of at least about two inches and a longitudinal length of at least about one inch.

3. The snowshoe of claim 1, wherein said aperture has a transverse width of at least about three inches and a longitudinal length of at least about one inch.

4. The snowshoe of claim 1, further comprising:

first and second longitudinal side bars extending downwardly from said flotation means and separated from each other by a transverse distance; and means for pivotably attaching said platform to said first and second side bars.

5. The snowshoe of claim 1, further comprising binding means for binding said snowshoe to a wearer's foot, said binding means comprising:

a) first strap means for engaging a toe section of said wearer's foot adjacent a front edge of said wearer's foot;

b) second strap means for engaging a heel section of said wearer's foot adjacent a rear edge of said wearer's foot;

c) foot wrap means, formed from flexible material, for wrapping about sections of said wearer's foot so as to securely engage said wearer's foot, said foot wrap means including:

i) a base portion for attachment to said platform means; and ii) first and second side portions extending around first and second side sections of said wearer's foot, said first and second side sections corresponding to the sides of said wearer's foot from the ball to the instep of said wearer's foot;

d) first attachment means for interconnecting said first strap means to each of said first and second side portions of said foot wrap means; and e) second attachment means for interconnecting said second strap means to each of said first and second side portions of said foot wrap means.

6. The snowshoe of claim 5, wherein said binding means further comprises at least one rigid buckle for adjusting said binding means and an enlarged flexible tab attached to said buckle to facilitate hand manipulation of said buckle.

7. A snowshoe, comprising:

a) flotation means for providing a snow contact surface area, said flotation means having a longitudinal length and a transverse width;

b) first and second longitudinal side bars extending downwardly from said flotation means and separated from each other by a transverse distance, each of said side bars having a front end and a rear end;

c) a first rear rib formed in said flotation means, said first rear rib defining an indentation in a bottom surface of said flotation means and extending longitudinally from a trailing end of said flotation means past said rear end of one of said longitudinal side bars; and d) pivotable platform means for interfacing said flotation means and a wearer's foot, said platform means comprising a rigid platform having an aperture and a flexible covering disposed on said platform so as to cover said aperture.

8. The snowshoe of claim 7, further comprising a second rear rib, wherein said first rear rib is disposed adjacent said first side bar and said second rear rib is disposed adjacent said second side bar.

9. The snowshoe of claim 7, further comprising a first front rib formed in said flotation means, said first front rib defining an indentation in said bottom surface of said flotation means and extending longitudinally from a front portion of said flotation means past said front end of said first side bar.

10. The snowshoe of claim 7, comprising at least two front ribs, each of said at least two front ribs extending from a front portion of said flotation means past said front ends of each of said first and second side bars.

11. The snowshoe of claim 7, further comprising extension means, detachably coupled to said flotation means, for selectively increasing the snow contact surface area of said snowshoe.

12. The snowshoe of claim 7, further comprising brake means, disposed adjacent at least one of said side bars and angled relative to said at least one of said side bars, for exerting a braking force when said snowshoe slides over snow.

13. The snowshoe of claim 7, wherein said bottom edge of each of said first and second side bars has indentations formed therein.

14. The snowshoe of claim 7, further comprising a binding for attachment to a wearer's foot, said binding including at least one rigid buckle for adjusting said binding and an enlarged, flexible tab attached to said buckle to facilitate hand manipulation of said buckle.

* * * * *